United States Patent [19]

Ohashi

[11] 4,347,990

[45] Sep. 7, 1982

[54] METHOD AND APPARATUS FOR STOPPING PACKAGES IN AUTOMATIC WINDER

[75] Inventor: Kenji Ohashi, Uji, Japan

[73] Assignee: Murata Kikai Kabushiki Kaisha, Japan

[21] Appl. No.: 170,069

[22] Filed: Jul. 18, 1980

[30] Foreign Application Priority Data

Jul. 19, 1979 [JP] Japan ..... 54-92351

[51] Int. Cl.[3] ..... B65H 63/02

[52] U.S. Cl. ..... 242/36; 242/37 R

[58] Field of Search ..... 242/36, 37 R, 39, 18 DD, 242/35.5 R, 35.6 R

[56] References Cited

U.S. PATENT DOCUMENTS

| | | | |
|---|---|---|---|
| 1,205,565 | 11/1916 | Rand et al. | 242/39 X |
| 1,801,378 | 4/1931 | Swanson | 242/36 |
| 1,941,724 | 1/1934 | Swanson | 242/18 DD |
| 2,311,175 | 2/1943 | Hitt | 242/36 |
| 2,338,914 | 1/1944 | Esser et al. | 242/35.6 R |
| 2,363,988 | 11/1944 | Peterson | 242/37 R |
| 3,044,733 | 7/1962 | Ingham, Jr. | 242/18 DD X |
| 3,252,666 | 5/1966 | Bagwell, Jr. | 242/18 DD |
| 3,563,480 | 2/1971 | Crouzet | 242/36 |

*Primary Examiner*—Stanley N. Gilreath

*Attorney, Agent, or Firm*—Whittemore, Hulbert & Belknap

[57] ABSTRACT

In an automatic winder wherein a winding package rotates while having surface contact with a transverse drum which is positively rotated, a method and apparatus for stopping the package concurrently with stopping of the drum. The method includes a braking of the drum when brakage of yarn being wound on the package takes place and simultaneous braking of the winding package if the brakage of the yarn takes place after the winding package has reached a predetermined diameter. The structure includes drum brake structure for braking the drum, lever actuated cam structure for sensing the diameter of the winding package, and package brake structure responsive to the diameter sensing structure for stopping the winding package on sensing of yarn brakage and package diameter over a predetermined diameter.

9 Claims, 5 Drawing Figures

METHOD AND APPARATUS FOR STOPPING PACKAGES IN AUTOMATIC WINDER

BACKGROUND OF THE INVENTION

In an automatic winder, a winding package rotates while having surface contact with a traverse drum positively rotated and winds a yarn thereon while making this rotation movement. According to the conventional method, when yarn breakage takes place, the drum is braked to stop the drum and the package is stopped with stopping of the drum.

According to this conventional stopping method, the package is stopped with stopping of a drum while the package is kept in contact with the drum. Therefore, while the amount of a yarn is small, the package is stopped with stopping of the drum, but when the amount of the wound yarn is increased, the package is not immediately stopped only by stopping the drum and the package continues to rotate by inertia even after the drum is stopped, with the result that a slip is caused between the package and the surface of the drum. In this case, since the surface of the yarn layer is pressed by the drum surface and a slip is caused therebetween, friction is caused on the yarn per se to degrade the quality of the yarn, and as the yarn end is pressed by the drum, the yarn end is intruded into the surface of the yarn layer on the package and a mistake is caused at the time of pick finding when the yarn knotting operation is performed.

SUMMARY OF THE INVENTION

The present invention relates to a method and apparatus for stopping packages in an automatic winder.

An object of the present invention is to provide a method and apparatus for stopping the package concurrently with stopping of a drum for the package without an occurrence of a slip between the package and the surface of the drum. The present invention is characterized in that until the quantity of the yarn layer on the package is increased to a predetermined level, the package is stopped with stopping of the drum and after the quantity of the yarn layer on the package exceeds this predetermined level, both the drum brake and the package brake are simultaneously actuated to stop the package.

According to the present invention, when the diameter of the winding package driven under contact with the surface of the drum is smaller than the predetermined set value, on occurrence of yarn breakage the package is stopped by the drum brake, and when the diameter of the package exceeds the predetermined set value, both the drum brake and the package brake are simultaneously actuated while keeping the package in contact with the drum, whereby the package is stopped. Accordingly, such troubles as damage of the surface of the yarn layer by inertia rotation of the package and intrusion of the yarn end into the yarn layer are not caused at all. Therefore, a wound package having a good quality can be obtained, and simultaneously, pick finding can be accomplished very easily at the yarn ending operation conducted after occurrence of yarn breakage.

Furthermore, since the package brake need not be actuated every time yarn breakages takes place, wearing of the brake shoe is prevented, and since both the package and the drum are simultaneously braked, a strong package brake need not be particularly used.

DETAILED DESCRIPTION OF THE INVENTION

The present invention will now be described in detail with reference to one embodiment illustrated in the accompanying drawings.

Figure 1:
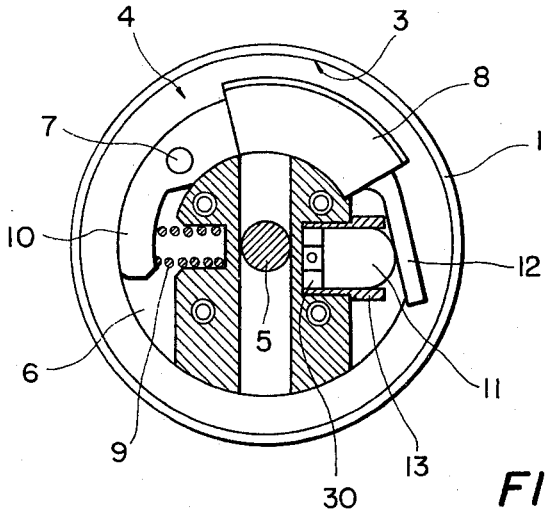
FIG. 1 is a sectional front view illustrating one embodiment of the package brake.
Figure 2:
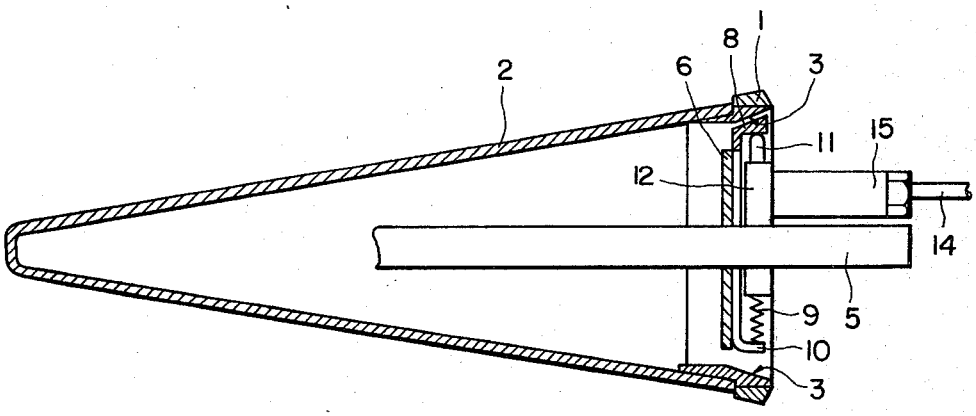
FIG. 2 is a partial sectional view illustrating the side of the package brake shown in FIG. 1.

Referring to FIGS. 1 and 2 illustrating one example of the package brake, a bobbin 2 is supported by a bobbin holder 1, and a brake 4 pressed to the inner circumferential surface 3 of a large-diameter opening portion of the bobbin holder 1 is pivoted at shaft 7 on a substantially circular plate 6 supported by a shaft 5. Practically, the brake 4 has an integrated structure comprising a brake shoe 8 having pressing contact with the inner circumference of the bobbin holder 1, a spring support member 10 supported on shaft 7 to separate the shoe 8 from the inner circumference of the bobbin holder 1 by a spring 9 and an operating piece 12 pressed to a projecting pin 11 to bring the brake shoe 8 into pressing contact with the inner circumference of the bobbin holder 1. The pin 11 emerges along a cylindrical guide 13 in a direction at a right angle to the shaft 5, and the pin 11 is driven by compressed air supplied to a clearance 30 between the pin 11 and cylindrical guide 13. A pipe 14 is connected to a compressed air supply source and also to a nozzle 15 from which compressed air is jetted to the pin 11. Jetting of compressed air from the nozzle is effected only when a microswitch of a yarn breakage sensing device is put on and another microswitch described hereinafter is put on.

Figure 3:
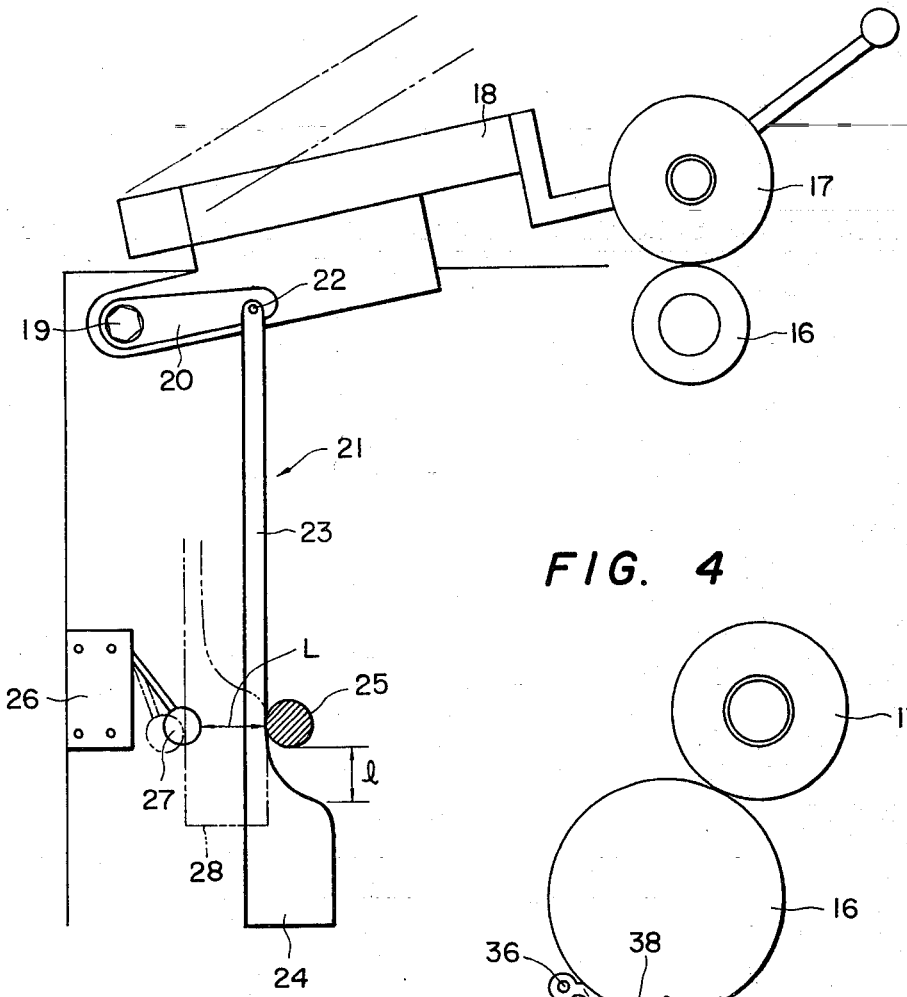
FIG. 3 is a side view of the winder, which illustrates the device for actuating the package brake.

FIG. 3 illustrates a device detecting that the wound quantity on the package exceeds a predetermined set value, and a cradle arm 18 is disposed swingably with a stationary shaft 19 being as the center to support a rotating package 17 by surface contact with a drum 16. This cradle arm 18 is arranged so that with increase of the yarn layer on the package 17, it turns counterclockwise with the shaft 19 being as the center.

A lever 20 is screwed to the shaft 19 and a cam plate 21 is freely pivoted at a point 22 on the lever 20', cam plate 21 comprises a narrow portion 23 and a wide portion 24, which are formed contiguously to each other. The cam plate 21 is hung down between a fixed pin 25 and a contact piece 27 of a microswitch 26 so that the position of the cam plate 21 can be freely changed.

As the yarn layer on the package 17 is increased from the state shown in FIG. 3, the cradle arm 18 turns counterclockwise with the shaft 19 being as the center, and with the turning movement of the cradle arm 18, the lever 20 is raised up and the cam plate 21 hung down from the lever 20 is moved from the position indicated by a solid line in parallel gradually upward to the left. When the yarn layer is increased to the predetermined set value, the wide portion 24 of the cam plate 21 intrudes between the pin 25 and the contact piece 27 as indicated by a two-dot chain line and rises in this state to press the contact piece 27 of the microswitch 26 and put on the microswitch 26. The wide portion 24 has certain width and length which are predetermined so that the microswitch 26 is kept in the "on" state while the quantity of the yarn layer is increased from the predetermined value until winding is completed.

Incidentally, it is indispensable that the distance "L" between the contact piece 27 of the microswitch 26 and the fixing pin 25 should be larger than the width of the narrow portion of 23 of the cam plate 21 but smaller than the width of the wide portion 24 of the cam plate 21.

Figure 4:
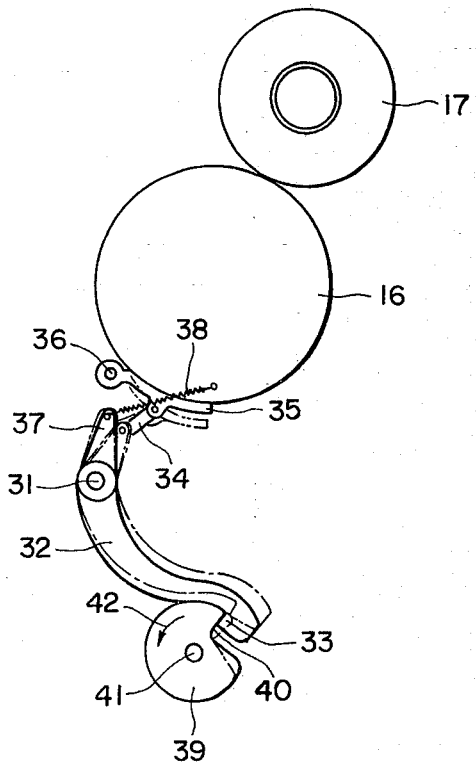
FIG. 4 is a side view illustrating one embodiment of the drum brake.

One embodiment of the drum brake is shown in FIG. 4. Referring to FIG. 4, a hook 33 is mounted on the lower end of a swinging arm 32 swingably mounted on a shaft 31, and the upper end of the swinging arm 32 is connected to a brake shoe 35 through a link 34. The brake shoe 35 turns with a shaft 36 being as the center and is brought into pressing contact with the drum 16.

A branched arm 37 turns integrally with the swinging arm 32 supported on the shaft 31 and a spring 38 mounted on the end of the branched arm 37 urges the swinging arm 32 to turn clockwise, that is, in a direction pressing the brake shoe 35 to the drum 16. A cam 39 having a stepped portion 40 is supported on a shaft 41 interlocked co-operatively to the driving shaft of a knotter so that the yarn ending operation is completed during one rotation of the cam 39. In the ordinary state where the drum is rotated and the yarn is wound on the package, the cam 39 is stopped at a position indicated by chain lines and also the swinging arm 32, link 34 and brake shoe 35 are located at positions indicated by chain lines.

When yarn breakage takes place, the yarn sensing device is put on and rotation of the cam 39 in a direction of arrow 42 is started, and the hook 33 of the swinging arm 32 is caused to fall in the stepped portion 40 of the cam 39. Accordingly, the swinging arm 32 is turned clockwise by the force of the spring 38 to turn the brake shoe 35 counterclockwise through the link 34 with the shaft 36 being as the center and bring the shoe brake 35 into pressing contact with the drum 16.

Figure 5:
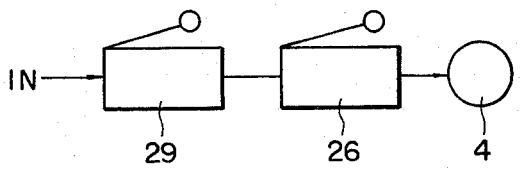
FIG. 5 is a block diagram showing the operation condition of the package brake.

FIG. 5 illustrates the operation condition of the package brake 4. Only when the yarn breakage sensing device 29 is put on and the microswitch 26 is put on, an operation instruction is put in the package brake 4. If only the microswitch 26 or only the yarn sensing device 29 is put on, the package brake 4 is not actuated.

Since the critical packaging diameter causing rotation by inertia at stopping of the package is changed according to package conditions such as the yarn winding speed, the presence or absence waxing on the yarn and the contact pressure to the drum, in the case where the package diameter actuating the package brake is determined by actual measurement and calculation and a package having a diameter "A", for example, is to be formed by winding, an arrangement is made so that the package brake is actuated when the diameter of the package is increased to "a" ($a<A$). More specifically, by adjusting the angle of lever 20 screwed to the shaft 19, the distance "l" between the fixing pin 25 and the wide portion 24 is appropriately set so that while the diameter of the package does not reach "a", the narrow portion 23 of the cam plate 21 is located between the pin 25 and the contact piece 27 and when the diameter of the package reaches "a", the wide portion 24 of the cam plate 21 presses the contact piece 27 of the microswitch 26. If the diameter of the package exceeds "a", the microswitch 26 is kept in the "on" state, and as soon as yarn breakage is caused, compressed air for the package brake is supplied, whereby the pin 11 shown in FIG. 1 is projected and the brake shoe 8 is turned counterclockwise with the shaft 7 being as the center and is pressed to the inner circumferential face of the pin holder 1 to stop rotation of the package. Simultaneously, the brake shoe 35 is pressed to the drum 16 with rotation of the cam 39 to stop the traverse drum 16.

While the diameter of the package 17 is smaller than "a", since the microswitch 26 is in the "off" state, the package brake is not actuated even if yarn breakage is caused, and the package is stopped by stopping of the drum.

According to experiments, it was confirmed that when a cotton yarn of count No. 40 is wound at a yarn speed of 900m/min and a contact pressure of 2 Kg under the condition of the absence of waxing and an arrangement is made so that when the diameter "a" of the package is 150 mm, the package brake is actuated, the package is stopped by the drum brake if the drum diameter is smaller than 150 mm and the drum brake and the package brake are actuated to stop the package assuredly without rotation by inertia if the diameter of the package exceeds 150 mm and while the diameter of the package is increasing to the final diameter.

The diameter "a" not causing inertia rotation on stopping of the package only by the drum brake is set as the package diameter actuating the package brake in the above embodiment. However, this diameter may be changed according to the quality of the yarn, the yarn winding speed, the presence or absence of waxing, the contact pressure and other conditions. Furthermore, this set value of the diameter may be changed for attaining peculiar objects.

What is claimed is:

1. A method for stopping a winding package driven under contact with the surface of a driven drum in an automatic winder comprising the steps of stopping the drum, sensing whether the diameter of the winding package is at or above a predetermined diameter and separately stopping the winding package when it is sensed that the diameter of the winding package is at or greater than the predetermined diameter.

2. The method as set forth in claim 1, and further including the step of stopping the drum in response to a break in yarn being wound on the winding package.

3. The method as set forth in claim 1, wherein the stopping of the winding package is further in response to a break in yarn being wound on the winding package.

4. An apparatus for stopping a winding package driven under contact with the surface of a driven drum in an automatic winder comprising a brake device operably associated with the drum for stopping the drum, a sensing device operably associated with the winding package for detecting a winding package diameter equal to or greater than a predetermined diameter and a brake device operably associated with the winding package and sensing device for separately stopping the winding package only when the diameter of the winding package is at or greater than a predetermined diameter in response to the sensing device.

5. Apparatus for stopping a winding package as set forth in claim 4, wherein the brake device for stopping the drum comprises a brake shoe, means pivotally mounting the brake shoe for swinging movement into contact with the drum for stopping the drum and away from the drum out of contact with the drum for permitting rotary motion of the drum, a swinging arm, a pivotal mounting for the swinging arm positioned centrally of the swinging arm, a link pivotally mounted at the opposite ends thereof to the brake shoe centrally thereof and to one end of the swinging arm, a hook formed on the other end of the swinging arm, resilient means engaging the one end of the swinging arm urging the brake shoe through the link into engagement with the drum and a rotatably supported cam in contact with the other end of the swinging arm having a step portion therein adapted to receive the hook portion formed on the other end of the swinging arm in one rotated position of the cam for permitting movement of the swinging arm under bias of the resilient means to engage the brake shoe with the drum.

6. Apparatus for stopping a winding package as set forth in claim 4, wherein said sensing device for detecting a diameter of the winding package comprises a craddle arm, means pivotally mounting the craddle arm at one end thereof, means rotatably mounting the winding package at the other end thereof, an adjustable lever one end of which is secured to the one end of the craddle arm the angular position of which is adjustable about the one end of the craddle arm, a cam plate pivotally secured to the other end of the lever having a cam surface thereon, a fixed pin positioned adjacent the cam plate in contact with the cam lever thereon, and a switch positioned on the opposite side of the cam plate from the cam surface whereby on rotation of the craddle arm in accordance with the diameter of yarn on the winding package, the cam plate is moved with the lever and in engagement with the pin into and out of engagement with the switch in response to a predetermined diameter of yarn on the winding package.

7. An apparatus for stopping a winding package as set forth in claim 4, wherein the brake device for separately stopping the package comprises an annular bobbin holder having an inner circumference for receiving the package for rotation therewith, a brake shoe, means pivotally mounting the brake shoe for movement toward and away from the inner circumference of the bobbin holder, resilient means urging the brake shoe into engagement with the inner circumference of the bobbin holder, a projection pin, and means for engaging the brake shoe with the projection pin to force the brake into contact with the inner circumference of the bobbin holder in opposition to the resilient means.

8. An apparatus for stopping a winding package as set forth in claim 7, wherein the means for engaging the brake shoe with the projection pin includes compressed air drive means.

9. An apparatus for stopping a winding package as set forth in claim 7, wherein the compressed air drive means includes a microswitch actuator.

* * * * *